US009392897B2

(12) United States Patent
Howsey

(10) Patent No.: US 9,392,897 B2
(45) Date of Patent: Jul. 19, 2016

(54) RETRACTABLE REELED GARMENT HANGER

(71) Applicant: Justin Howsey, Odessa, TX (US)

(72) Inventor: Justin Howsey, Odessa, TX (US)

( * ) Notice: Subject to any disclaimer, the term of this patent is extended or adjusted under 35 U.S.C. 154(b) by 0 days.

(21) Appl. No.: 14/564,174

(22) Filed: Dec. 9, 2014

(65) Prior Publication Data

US 2015/0157155 A1 Jun. 11, 2015

Related U.S. Application Data

(60) Provisional application No. 61/913,990, filed on Dec. 10, 2013.

(51) Int. Cl.

| | |
|---|---|
| ***A47G 25/32*** | (2006.01) |
| ***A47G 25/40*** | (2006.01) |
| ***A47G 25/06*** | (2006.01) |

(52) U.S. Cl.

CPC ..... *A47G 25/32* (2013.01); *A47G 25/065* (2013.01); *A47G 25/40* (2013.01)

(58) Field of Classification Search

CPC ..... A47G 25/02; A47G 25/06; A47G 25/065; A47G 25/14; A47G 25/32; A47G 25/40; A47G 25/44; A47G 25/0678; A47F 5/10; A47F 7/19; B65B 25/20

See application file for complete search history.

(56) References Cited

U.S. PATENT DOCUMENTS

| | | | | |
|---|---|---|---|---|
| 1,009,522 | A * | 11/1911 | Hunter | A47G 25/442 223/90 |
| 1,908,983 | A * | 5/1933 | Kabat | A47G 25/56 53/241 |
| 2,118,786 | A * | 5/1938 | Chestnutt | D06F 73/00 223/69 |
| 2,421,051 | A | 5/1947 | Brinkman | |
| 2,588,235 | A * | 3/1952 | Herrick | A47G 25/4076 200/81 H |
| 2,646,890 | A * | 7/1953 | Kraft | A47G 25/02 211/117 |
| 2,649,233 | A * | 8/1953 | Ingraham | A47G 25/56 53/241 |
| 2,705,097 | A | 3/1955 | Williams | |
| 2,937,796 | A | 5/1960 | Donahue | |
| 5,346,054 | A * | 9/1994 | Kawasaka | B65G 9/002 198/465.4 |
| 5,601,219 | A * | 2/1997 | Chen | A47G 25/28 223/85 |
| 8,245,441 | B1 | 8/2012 | Domek | |
| 2012/0234876 | A1 | 9/2012 | Diamond | |
| 2013/0221041 | A1 | 8/2013 | Wittenstein | |

FOREIGN PATENT DOCUMENTS

DE 10148580 A1 * 4/2003

* cited by examiner

*Primary Examiner* — Ismael Izaguirre

(74) *Attorney, Agent, or Firm* — Daniel Boudwin; Global Intellectual Property Agency, LLC.

(57) ABSTRACT

The present invention provides a garment hanger designed to maximize closet space. The device includes a garment hanger having a hook portion and a body portion connected by a retractable reel having a spring-biased spool with a cord wound thereon. The hook is substantially C-shaped and is designed to be hung on a closet rod or other means. The body portion is substantially triangular and designed to hang clothes thereon. The cord includes a proximal end permanently attached to the spring-biased spool and a distal end attached to the upper portion of the body portion. The retractable reel is configured to extend, retract, and latch the cord in a desired length. The retractable reel is also equipped with a spring-loaded pawl configured to engage and lock the spring-biased spool in a given state and prevent the spring-loaded spool from retracting the cord back onto the spool.

14 Claims, 2 Drawing Sheets

RETRACTABLE REELED GARMENT HANGER

CROSS REFERENCE TO RELATED APPLICATION

This application claims the benefit of U.S. Provisional Application No. 61/913,990 filed on Dec. 10, 2013. The above identified patent application is herein incorporated by reference in its entirety to provide continuity of disclosure.

BACKGROUND OF THE INVENTION

1. Field of the Invention

The present invention relates to garment hangers and closet space More specifically, the present invention pertains to an improved garment hanger that includes a retractable wheel that is designed to maximize space in a closet. The present invention includes a hook portion attached to a housing enclosing a retractable reel having a spring-biased spool wound with a cord. One end of the cord is attached to the upper portion of the body portion. The retractable reel is configured to extend, retract, and latch the cord in any desired length.

One of the frustrations of living in a small or poorly designed space is lack of storage. Some articles one cannot live without, and as one gets older, the more things that will be accumulated. Some belongings may start spilling out into the living space because the closet does not need any more space. A closet may need a makeover and when closet space is at a premium, it is important to make every inch count. Some planning and a few changes will possibly net some prime storage real estate in what was once a jam-packed closet.

For example, utilizing the floor for a combination of off-season storage, accessories and shoes may be sensible. The best storage option may be a low-lying cubby. Or another option to creating more space is hanging more clothing. Suits are not the only articles of clothing that are hung. Blankets, coats, dress shirts, handbags, pants, scarves and ties can all be hung now. Hangers may be used to hold clothes of the same type for organization. Another option is doubling the hanging space. Adding an additional closet rod may be more efficient than shelving space.

However, some items are high hanging and out of reach. These types of closets have multiple tiers or other high corners that are inconvenient and difficult to reach. Utilizing the closet space close to the ceiling will provide the maximum storage space available, however, reaching these the difficulty of retrieval is readily apparent. The difficulty only increases if the owner has a limited range of motion.

The present invention provides a solution to these problems by maximizing closet space and allowing easy access hanging clothes. The present invention provides a garment hanger configured to allow the body portion to extend away from the hook portion in a desired length, essentially adding a plurality of layers for hanging on a closet rod. The garment hanger comprises a hook portion and body portion connected by a housing enclosing a retractable reel having a spring-biased spool wound with a cord. The cord comprises a proximal end and a distal end, wherein the proximal end is attached to spring-biased spool, and the distal end is attached to the upper portion of the body portion. The retractable reel is equipped with a latching mechanism that allows the extension, retraction, and latching of the cord at a desired length. The body portion is substantially triangular and designed for clothes to be hung thereon.

2. Description of the Prior Art

Devices have been disclosed in the prior art that relate to hangers. These include devices that have been patented and published in patent application publications. Some devices disclose a device for hanging a load from an awning having a housing, a rotatable spool within the housing, a cord and a cinching member. Other devices disclose a pant hanger structure attached to a garment hanger having a rectangular holder with a central disposed slit therethrough the holder. These devices, however, do not disclose a garment hanger having a hook portion and body portion connected by a retractable reel having a spring-biased spool with a cord wound thereon. The foregoing is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 8,245,441 to Domek provides a pull-down planter hanger. The Domek device is an apparatus for hanging a load from awnings, ceilings or wall brackets. The Domek device provides a housing, a rotatable spool within the housing, a biasing member operably connected to the spool, and providing a limited force to urge the spool to rotate in a direction. The load is suspended from a cord that is constantly urged to a wound-up position on a spool held above the load. The load can be lowered by overcoming the winding force and a cinching member provides a clamping action of the cord against a clamping surface of the housing to deter movement of the cord relative to the housing. However, the Domek device does not provide a device that has a hook and body portion that is attached to each other with a retractable reel equipped with a latching mechanism.

Similarly, U.S. Pat. No. 2,937,796 to Donahue provides a pant hanger structure that is attached to a conventional wire garment hanger. The Donahue device provides a rectangular holder having a central disposed slit therethrough the holder. He cuffs of a pair of trousers are gripped together and pulled through the slit. The Donahue device can be attached to the hanger or to the upper hook portion of the hanger. However, the Donahue device also does not provide a garment hanger having a retractable reel equipped with a latching mechanism.

U.S. Pat. No. 2,705,097 to Sherrard provides a garment hanger having a detachable shoulder form designed to support garments normally hung in the shoulder region thereof, such as coats and clamping sections designed to support garments normally supported in a folded condition such as trousers. The Sherrard device has a clamping section with a pair of substantially inverted Y-shaped panels attached to a curved hook extension on the upper end. Hinge means are used to engage said panels together. The Sherrard device has a shoulder form for the reception of shoulder-supported garments. However, the Sherrard device does not provide a garment hanger having a retractable reel to allow the body portion to be extended away from the hook portion.

U.S. Pat. No. 2,421,051 to Brinkman provides a coat hanger designed to suspend a coat and two pairs of trousers. The Brinkman device discloses a hanger hook connecting to the body of the hanger by vertical wire members. A supplementary hanger consists of a plurality of plates interconnected at their ends and designed to fold substantially on a plane. The center plate has a rectangular opening centrally therein. However, the Brinkman device does not provide a device that has a hook and body portion connected to a retractable reel equipped with a latching mechanism.

Published U.S. Patent Application Number 2012/0234876 to Diamond is a garment hanger having a hook insert designed to facilitate nesting of one hanger with the other like hanger. The Diamond device is an insert for a garment hanger disclosing a body having a hook on one side, a flange on the other side, and a hole therethrough, wherein the hole is sized to receive another hook from a corresponding insert. However, the Diamond device does not provide a garment hanger including a retractable reel equipped with a latching mechanism to extend, retract and latch the body portion in a desired length.

Finally, Published U.S. Patent Application Number 2013/0221041 to Wittenstein is a hanger assembly for a garment including a neck opening and a pair of shoulder areas. The Wittenstein device discloses a frame having a pair of lateral ends and a suspensor coupled to the frame to transition between a pair of locations along said frame. However, the Wittenstein device does not provide a device that has a hook and body portion that is attached with a retractable reel equipped with a latching mechanism.

The devices disclosed in the prior art have several known drawbacks. Some devices disclose a device for hanging a load from an awning having a housing, a rotatable spool within the housing, a cord and a cinching member. Other devices disclose a pant hanger structure attached to a garment hanger having a rectangular holder with a central disposed slit therethrough the holder. These devices, however, are limited and do not disclose a garment hanger having a hook and body portion connected by a retractable reel and a cord.

The present invention provides a garment hanger having a hook portion and body portion connected by a retractable reel having a spring-biased spool wound with a cord. The cord includes a proximal end attached to the spring-biased spool, while the distal end is attached to the upper portion of the body portion. The retractable reel is equipped with a latching mechanism that is configured to extend, retract, and latch the cord in a desired length. It is therefore submitted that the present invention is substantially divergent in design elements from the prior art, and consequently it is clear that there is a need in the art for an improvement garment hangers. In this regard, the instant invention substantially fulfills these needs.

SUMMARY OF THE INVENTION

In view of the foregoing disadvantages inherent in the known types of garment hangers now present in the prior art, the present invention provides a new and improved retractable reeled garment hanger designed to extend and retract the body portion from the hook portion.

It is therefore an object of the invention to provide a new and improved retractable reeled garment hanger that has all of the advantages of the prior art and none of the disadvantages.

Another object of the present invention is to provide a new and improved retractable reeled garment hanger that is designed to maximize closet space.

Another object of the present invention is to provide a new and improved retractable reeled garment hanger that includes a hook and body portion connected by a retractable reel having a spring-biased spool wound with a cord thereon.

Yet another object of the present invention is to provide a new and improved retractable reeled garment hanger that is configured to allow the body portion of a garment hanger to extend and retract from the hook portion.

A further object of the present invention is to provide a new and improved retractable reeled garment hanger wherein the retractable reel is equipped with a latching mechanism to extend and retract the cord, as well as latch the cord in a desired length.

Still yet another object of the present invention is to provide a new and improved retractable reeled garment hanger wherein the device may be readily fabricated from materials that permit relative economy and are commensurate with durability.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein the numeral annotations are provided throughout.

DETAILED DESCRIPTION OF THE INVENTION

Figure 1:
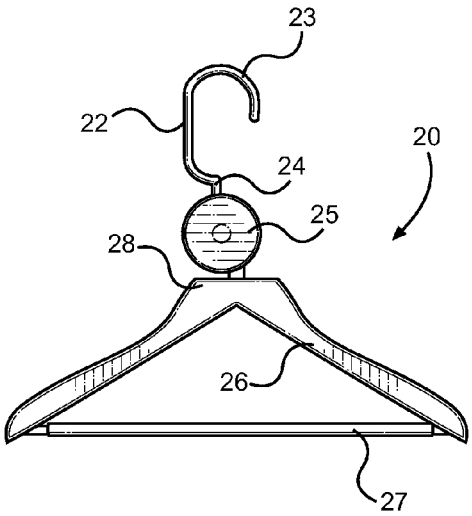
FIG. 1 shows a perspective of the present invention in the retracted configuration.

References are made herein to the attached drawings. Like reference numerals are used throughout the drawings to depict like or similar elements of the retractable reeled garment hanger. For the purposes of presenting a brief and clear description of the present invention, the preferred embodiment will be discussed as hung in a closet on a rod. The figures are intended for representative purposes only and should not be considered to be limiting in any respect.

Referring now to FIG. 1, there is shown a perspective of the retractable reeled garment hanger 20 in the retracted configuration. The garment hanger 20 is designed to maximize closet space by providing a hanger 20 that can be hung on a clothing rod and extended away therefrom. The hanger 20 comprises a hook portion 21 and a body portion 22 connected by a housing 25. The hook portion 21 is substantially C-shaped having a first end 23 and a second end 24. The hook portion is designed to be hung on a closet rod or other means purported for hanging items. The second end 24 of the hook 21 is attached to the housing 25 encasing the retractable reel having a spring-biased spool wound with a cord.

The body portion 22 is substantially shaped like an isosceles triangle having an upper portion 28, sides 26, and a base 27. The body portion 22 is designed to hang articles and items of clothing on the sides 26 or the base 27. Articles that can be hung thereon include, without limitation, include jackets, blazers, skirts, and blouses and trousers. The proximal end of the cord is permanently attached to the spring-biased spool of the retractable reel, whereas the distal end of the cord is attached to the upper portion of the body portion 22. The retractable reel is also equipped with a latching mechanism that is configured to extend, retract, and latch the cord in a desired length. As illustrated in FIG. 1, there is shown the hanger 20 in a fully retracted state.

Figure 2:
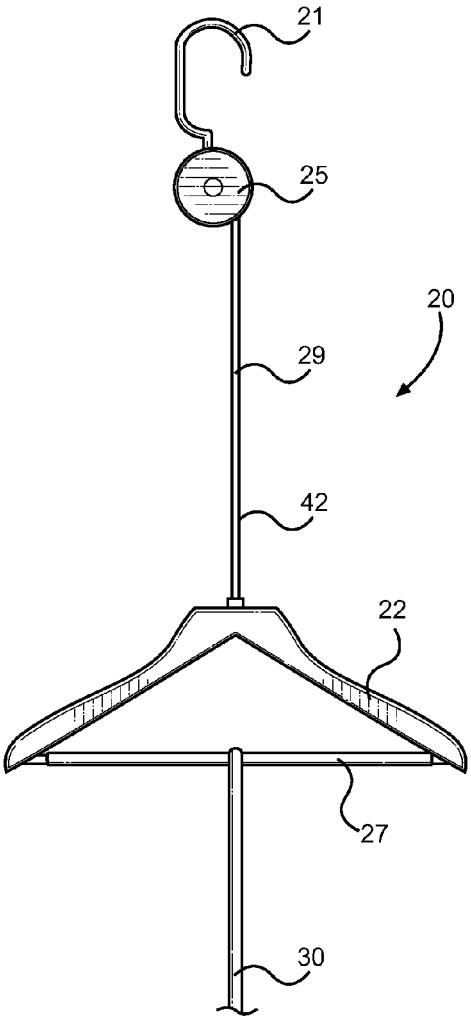
FIG. 2 shows a perspective of the present invention in the extended configuration.

Referring now to FIG. 2, there is shown a perspective of the hanger 20 in an extended state. The distal end 42 of the cord 29 is permanently attached to the upper portion 28 of the body portion 22, whereas the proximal end of the cord 29 is permanently attached to the spring-biased spool of the retractable reel encased by the housing 25. Hanger 20 is configured to allow a user to extend the body portion 22 away from the housing 25 and latch to a desired length. As can be recognized, the hanger 20 can provide a tiered hanging system or assist a user in reaching articles hung on a high-hanging clothing rod that is difficult to reach. Especially for a user with limited range in motion, the hanger 20 can be extended in a desired length that allows for a user to not overstretch their own abilities to reach for an article of clothing hung thereon.

The hook portion 21, body portion 22, and housing 25 are constructed preferably of a thermoplastic or thermoset material, however, without limitation, other suitable material is used in other embodiments. In the preferred embodiment, the cord 29 is composed of nylon, however, other embodiments compose the cord 29 with polystyrene, rubber, or other suitable material. In addition, the body portion 22 may also further comprise of clips or a locking pant bar. Clips are configured to suspend a variety of articles of clothing such as a skirt, whereas a locking pant bar is designed to hang the trousers thereon.

The body portion 22 may also further comprise a handle rope 30. The handle rope 30 provides aid and access to a high-hanging hanger 20 by allowing a user to simply grab thereon to extend the body portion 22 towards him or her. Handle rope 30 is a strong thin string of material that is attached to substantially the center of the base 27. In some embodiments, without limitation, the handle rope 30 is attached to substantially the middle of the base 27 by a cord tie, a shock cord fastener, or other suitable types of fasteners.

Figure 3:
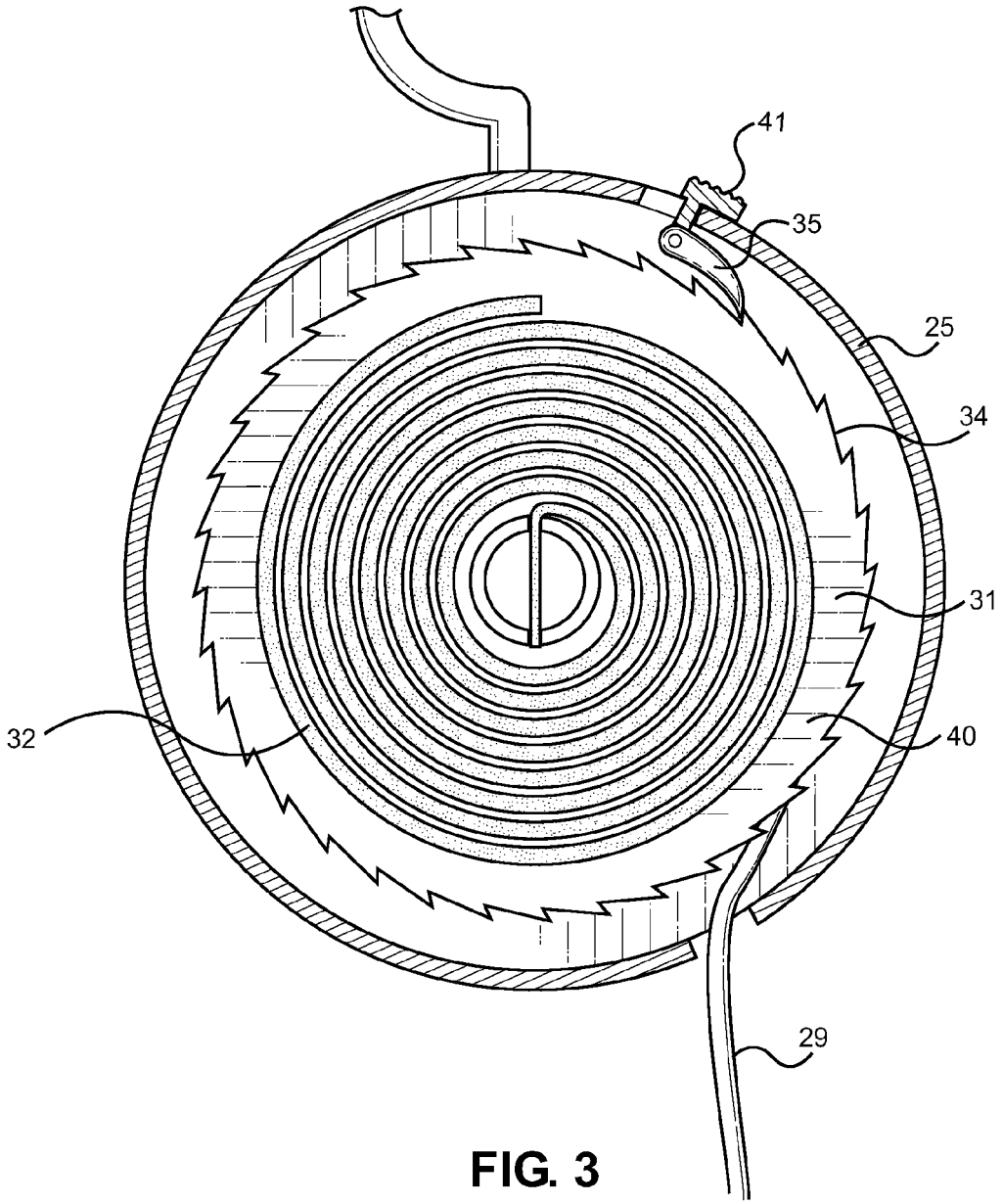
FIG. 3 shows a cross section view of the contents within the housing of the present invention.

Referring now to FIG. 3, there is shown a transparent view of the housing 25. The housing 25 is preferably circular and encloses a retractable reel 31 having a spring-biased spool 40 with the cord 29 wrapped therearound. The cord 29 is permanently attached to the spring-biased spool 40 at the proximal end to prevent the cord 29 from being fully extracted from the spring-biased spool 40. The spring-biased spool 40 is biased with a torsion spring 32 that allows the cord 29 to be retracted back onto the spring-biased spool 40. In addition, the spring-biased spool 40 further comprises jagged teeth 34 on the peripheral edge, wherein the jagged teeth 34 allow for unrestricted movement in one direction. Retractable reel 31 is equipped with a spring-loaded pawl 35 that is designed to engage the jagged teeth 34 and prevent the torsion spring 32 from retracting the cord 29 back onto spring-loaded spool 40.

The jagged teeth 34 allow the spring-loaded pawl 35 to slide up and over the gently sloped edges of the jagged teeth 34 to provide unrestricted movement in one direction. However, the spring-loaded pawl 35 catches against the steeply sloped edges of the jagged teeth 34, thereby locking the spring-loaded pawl 35 against the jagged teeth 34 and preventing any further motion in the reverse direction. The pawl 35 is also connected to a releasable trigger 41, which pivots and disengages the pawl 35 from the jagged teeth 34 to provide unrestricted movement in the reverse direction. As the pawl 35 is disengaged, the cord 29 is allowed to be wound back thereon the spool 40. The releasable trigger 41 is depressible to act on the spring-loaded pawl 35 and disengages the spring-loaded pawl 35 from the jagged teeth 34. The releasable trigger 41 is released to allow the spring-loaded pawl to re-engage the jagged teeth 34.

Retractable reel 31 is an exemplar of a latching mechanism enclosed within housing 25. Other embodiments may use other means for ratcheting or latching to extend, retract, and latch the cord in a given length.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above descriptions then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specifications are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A retractable reeled garment hanger, comprising:
a hook portion having a first end and a second end;
a housing connecting said hook portion to a body portion;
said body portion having an upper end, a pair of sides, and a base;
said second end of said hook portion attached to said housing;
said housing enclosing a retractable reel;
said retractable reel having a spring-biased spool of cord;
said cord having a proximal end, a distal end, and wrapped around said spring-biased spool;
a spring-loaded pawl configured to lock the spring-biased spool in a given state;
said proximal end permanently attached to said spring-biased spool;
said distal end being attached to said body portion; and
a handle extending from the base.

2. The retractable reeled garment hanger of claim 1, wherein said hook is substantially C-shaped and configured to be hung on a closet rod or other means of hanging items.

3. The retractable reeled garment hanger of claim 1, wherein said body portion is substantially shaped as an isosceles triangle and configured to support articles of clothing thereon.

4. The retractable reeled garment hanger of claim 1, wherein said retractable reel is configured to extend, retract, and latch said cord in a desired length.

5. The retractable reeled garment hanger of claim 1, wherein said spring-biased spool further comprising a torsion spring that acts on said spring-biased spool to return said cord onto said spring-biased spool once said cord is extended.

6. The retractable reeled garment hanger of claim 1, wherein when said cord is being pulled away from said housing, said torsion spring acts on said spring-biased spool to retract said cord back into said housing.

7. The retractable reeled garment hanger of claim 1, wherein said spring-loaded pawl is designed to prevent said torsion spring from retracting said cord back onto said spring-biased spool.

8. The retractable reeled garment hanger of claim 1, wherein said retractable reel further comprising jagged teeth on the peripheral edge, wherein said jagged teeth allow for unrestricted movement in one direction and said spring-loaded pawl engages and latches against said jagged teeth to prevent motion in a reverse direction.

9. The retractable reeled garment hanger of claim 1, wherein said spring-loaded pawl is disengaged from said jagged teeth and released by a releasable trigger.

10. The retractable reeled garment hanger of claim 1, wherein the handle is a rope handle.

11. The retractable reeled garment hanger of claim 1, wherein the handle is attached substantially to the center of said base.

12. The retractable reeled garment hanger of claim 1, wherein the handle is configured to allow a user to extend, retract, and latch said cord without having to reach said housing or said body portion.

13. The retractable reeled garment hanger of claim 1, wherein said body portion further comprises clips.

14. The retractable reeled garment hanger of claim 1, wherein the body portion further comprises a locking bar.

* * * * *